US010302053B2

(12) United States Patent
Aso

(10) Patent No.: US 10,302,053 B2
(45) Date of Patent: May 28, 2019

(54) FUEL TANK STRUCTURE

(71) Applicant: TOYOTA JIDOSHA KABUSHIKI KAISHA, Toyota-shi, Aichi-ken (JP)

(72) Inventor: Shuichi Aso, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/170,244

(22) Filed: Jun. 1, 2016

(65) Prior Publication Data

US 2017/0030310 A1 Feb. 2, 2017

(30) Foreign Application Priority Data

Jul. 27, 2015 (JP) ..... 2015-148038

(51) Int. Cl.
*F02M 25/08* (2006.01)
*F02M 59/00* (2006.01)
*F02M 37/00* (2006.01)

(52) U.S. Cl.
CPC .... *F02M 37/0082* (2013.01); *F02M 25/0836* (2013.01); *F02M 25/0854* (2013.01);
(Continued)

(58) Field of Classification Search
CPC ..... F02M 37/0082; F02M 25/0836; F02M 25/0854; F02M 25/0872; F02M 25/0017; F02M 37/0017
(Continued)

(56) References Cited

U.S. PATENT DOCUMENTS 3,583,593 A * 6/1971 Merritt ..... B64D 37/005 220/4.14
3,693,825 A * 9/1972 Richman ..... B60K 15/03504 220/227
(Continued)

FOREIGN PATENT DOCUMENTS

DE 69909862 T2 4/2004
DE 102007036112 A1 2/2009
(Continued)

OTHER PUBLICATIONS

Jun. 22, 2017 Office Action issued in German Patent Application No. 10 2016 110 559.7.

*Primary Examiner* — Sizo B Vilakazi
*Assistant Examiner* — Kevin R Steckbauer
(74) *Attorney, Agent, or Firm* — Oliff PLC

(57) ABSTRACT

A fuel tank structure comprising a fuel tank; a canister; a first pipe that joins together a holding portion of the fuel tank and the canister; a first shut-off valve provided at the first pipe; a filler pipe; a second pipe that joins together the filler pipe and the canister; a second shut-off valve provided at the second pipe; a pressure sensor that detects the pressure inside the holding portion; a fuel pump that feeds the fuel to an engine; and a control unit. The control unit opens the first shut-off valve during refueling such that evaporative fuel is permitted to move from the holding portion to the canister, and closes the first shut-off valve after refueling. The control unit opens the second shut-off valve when the pressure inside the holding portion detected by the pressure sensor drops below a predetermined pressure which is lower than the atmospheric pressure.

7 Claims, 6 Drawing Sheets

(52) U.S. Cl.
CPC .... *F02M 25/0872* (2013.01); *F02M 37/0017* (2013.01); *F02M 37/0023* (2013.01); *F02M 59/00* (2013.01)

(58) Field of Classification Search
USPC ..... 137/574
See application file for complete search history.

(56) References Cited

U.S. PATENT DOCUMENTS 4,852,761 A * 8/1989 Turner ..... B60K 15/03504 123/519
4,872,439 A * 10/1989 Sonoda ..... B60K 15/03504 123/516
5,596,971 A * 1/1997 Kidokoro ..... B60K 15/03504 123/516
5,603,349 A * 2/1997 Harris ..... B60K 15/035 123/519
5,722,374 A * 3/1998 Kidokoro ..... B60K 15/035 123/516
5,887,616 A * 3/1999 Ikeda ..... B60K 15/061 116/227
5,925,817 A * 7/1999 Kidokoro ..... B60K 15/03 73/40
6,176,260 B1 * 1/2001 Hahner ..... B60K 15/077 123/468
6,223,526 B1 * 5/2001 Wissler ..... B60K 15/03 60/286
6,336,446 B1 * 1/2002 Isobe ..... F02M 25/0809 123/198 D
6,371,089 B1 * 4/2002 Matsuoka ..... B60K 6/365 123/519
6,446,614 B1 * 9/2002 Matsuoka ..... F02D 29/06 123/516
6,491,180 B2 * 12/2002 Distelhoff ..... B60K 15/03177 220/4.14
6,543,426 B1 * 4/2003 Schwochert ..... B60K 15/03177 123/516
8,671,916 B2 * 3/2014 Ogaki ..... B60K 15/00 123/516
8,899,835 B2 * 12/2014 Russell ..... B65D 90/046 220/9.1
9,376,969 B2 * 6/2016 Yang ..... F02D 41/042
9,518,540 B2 * 12/2016 Pearce ..... F02M 33/025
9,695,983 B2 * 7/2017 Mackey ..... F17C 1/00
9,745,907 B2 * 8/2017 Dudar ..... F02D 41/0032
9,783,043 B2 * 10/2017 Aso ..... B60K 15/03
9,834,089 B2 * 12/2017 Aso ..... B60K 15/03
9,989,018 B2 * 6/2018 Dudar ..... F02D 41/0042
10,106,029 B2 * 10/2018 Aso ..... B60K 15/03
10,166,861 B2 * 1/2019 Aso ..... B60K 15/03
2002/0036204 A1 3/2002 Miura et al.
2006/0011173 A1 * 1/2006 Davis ..... B60K 15/03177 123/520
2010/0307459 A1 * 12/2010 Steinbach ..... F02D 41/3854 123/511
2011/0120425 A1 * 5/2011 Aso ..... F02M 25/089 123/520
2011/0139301 A1 * 6/2011 Hirose ..... B60K 15/035 141/199
2011/0192382 A1 * 8/2011 Ogaki ..... B60K 15/00 123/518
2014/0007849 A1 * 1/2014 Nagasaku ..... F02M 25/089 123/519
2014/0102420 A1 4/2014 Kimoto et al.
2014/0318506 A1 * 10/2014 Yang ..... F02D 41/042 123/519
2016/0361992 A1 * 12/2016 Aso ..... B60K 15/03
2016/0368370 A1 * 12/2016 Aso ..... B60K 15/03006
2016/0368374 A1 * 12/2016 Aso ..... B60K 15/03
2016/0369757 A1 * 12/2016 Aso ..... B60K 15/03
2017/0008394 A1 * 1/2017 Aso ..... B60K 15/03
2017/0198662 A1 * 7/2017 Dudar ..... F02D 41/0042
2017/0356360 A1 * 12/2017 Dudar ..... F02D 41/22
2019/0017453 A1 * 1/2019 Dudar ..... F02D 41/0037

FOREIGN PATENT DOCUMENTS

DE 102013016984 A1 4/2014
JP 5299565 B2 9/2013

* cited by examiner

FUEL TANK STRUCTURE

CROSS-REFERENCE TO RELATED APPLICATION

This application is based on and claims priority under 35 USC 119 from Japanese Patent Application No. 2015-148038 filed on Jul. 27, 2015, the disclosure of which is incorporated by reference herein in its entirety.

BACKGROUND

Technical Field

Preferred embodiments relate to a fuel tank structure.

Related Art

A structure in which a canister is provided in order to adsorb evaporative fuel (i.e., fuel vapor) is known as a structure for a fuel tank that is mounted in an automobile. In this kind of structure, because the evaporative fuel that has been adsorbed in the canister is purged using negative pressure from the intake manifold, pumping loss increases and it is difficult to improve fuel consumption.

To counter this, a structure has been disclosed in Japanese Patent Publication No. 5299565 in which a gas separator is connected to the fuel tank. In this structure, by operating the gas separator so that atmospheric constituents inside the fuel tank are discharged to the outside, the internal pressure in the fuel tank is reduced, and evaporative fuel that has been adsorbed in the canister is purged.

SUMMARY

However, in the fuel tank structure disclosed in Japanese Patent Publication No. 5299565, in addition to the gas separator that is used to reduce the internal pressure in the fuel tank, a mechanism to switch opening/closing of the canister and the gas separator is also required, so that the complexity of the structure increases. Moreover, because energy (i.e., power) to operate the gas separator is also required, there is also room for improvement from the standpoint of improving fuel consumption.

In consideration of the above circumstances, an object of preferred embodiments is to provide a fuel tank structure that makes it possible to improve fuel consumption by means of simple structure.

A fuel tank structure of a first aspect of the disclosure includes a fuel tank that is mounted in a vehicle and that is provided with a holding portion that holds fuel; a canister that communicates with the outside atmosphere; a first pipe that joins together the holding portion and the canister; a first shut-off valve that opens and closes the first pipe; a filler pipe that is connected to the holding portion, and that is provided with a refueling aperture into which a nozzle of a fueling gun is inserted and that remains closed other than during refueling; a second pipe that joins together the filler pipe and the canister; a second shut-off valve that opens and closes the second pipe; a pressure sensor that detects an pressure inside the holding portion; a fuel pump that feeds the fuel inside the holding portion to an engine; and a control unit that opens the first shut-off valve during refueling so that evaporative fuel is permitted to move from the holding portion to the canister, and that closes the first shut-off valve after refueling, and that also opens the second shut-off valve when the pressure inside the holding portion which is detected by the pressure sensor drops below a predetermined pressure which is lower than the atmospheric pressure.

In the fuel tank structure according to the first aspect of the disclosure, the fuel tank is provided with a holding portion that is used to hold fuel. A filler pipe is connected to the holding portion. The holding portion is joined to a canister by a first pipe and a first shut-off valve is provided at the first pipe. The filler pipe and the canister are joined together by a second pipe and a second shut-off valve is provided at the second pipe. Here, during refueling, the first shut-off valve is opened by the control unit so that the movement of evaporative fuel from the holding portion of the fuel tank to the canister is permitted. As a consequence of this, during refueling, the evaporative fuel inside the holding portion flows through the first pipe and is adsorbed in the canister, while gaseous components other than the evaporative fuel are discharged into the atmosphere. In this manner, the evaporative fuel is prevented from being discharged into the atmosphere.

After refueling, the first shut-off valve is closed. In this state, when the fuel inside the holding portion is fed to the engine by the fuel pump, the pressure inside the holding portion drops. In the event that the pressure inside the holding portion which is detected by a pressure sensor drops below a predetermined pressure that is lower than the atmospheric pressure, the control unit opens the second shut-off valve. As a consequence of this, air is introduced into the second pipe, and the evaporative fuel that had been adsorbed by the canister is purged from the canister. This evaporative fuel then flows into the filler pipe through the second pipe and flows into the holding portion. In this manner, it is possible to recover the evaporative fuel adsorbed by the canister by a simple structure without having to use an apparatus such as a gas separator.

The fuel tank structure of a second aspect of the disclosure, in the fuel tank structure according to the first aspect, wherein the second shut-off valve is formed so as to be able to adjust a flow rate of the evaporative fuel flowing through the second pipe, and the control unit controls the second shut-off valve such that the flow rate of the evaporative fuel flowing through the second pipe is less than a flow rate of the fuel being fed to the engine by the fuel pump.

In the fuel tank structure according to the second aspect of the disclosure, the flow rate of the evaporative fuel flowing through the second pipe is less than the flow rate of the fuel that is fed to the engine from the fuel pump. As a consequence of this, it is possible to maintain the pressure inside the holding portion as a negative pressure, and to stably recover evaporative fuel from the canister.

The fuel tank structure of a third aspect of the disclosure, in the fuel tank structure according to the first and second aspects, wherein the holding portion is formed so as to be able to expand and contract and a plurality of ribs are provided standing upright on a bottom portion of the holding portion.

In the fuel tank structure according to the third aspect of the disclosure, the holding portion is expanded as a result of fuel being supplied to the holding portion. The holding portion is contracted as a result of the fuel inside the holding portion decreasing. Here, because the plurality of ribs are provided standing upright on the bottom portion of the holding portion, a flow path for the fuel can be secured even when the holding portion is contracted, and fuel can be stably fed to the fuel pump.

As has been described above, according to the fuel tank structure of a first aspect of the disclosure, fuel consumption can be improved by a simple structure.

According to the fuel tank structure of a second aspect of the disclosure, the evaporative fuel recovery performance can be improved.

According to the fuel tank structure of a third aspect of the disclosure, a flow path can be secured for the fuel even when the holding portion is formed by a bag-shaped component that is able to expand and contract.

BRIEF DESCRIPTION OF THE DRAWINGS

Preferred embodiments will be described in detail based on the following figures, wherein.

DETAILED DESCRIPTION

Hereinafter, a fuel tank structure according to an embodiment will be described. Note that an arrow UP that is shown in the respective drawings shows the upward side of the fuel tank. Moreover, in the embodiments, the upward side of the fuel tank coincides with the upward side in the vertical direction of the vehicle.

Figure 1:
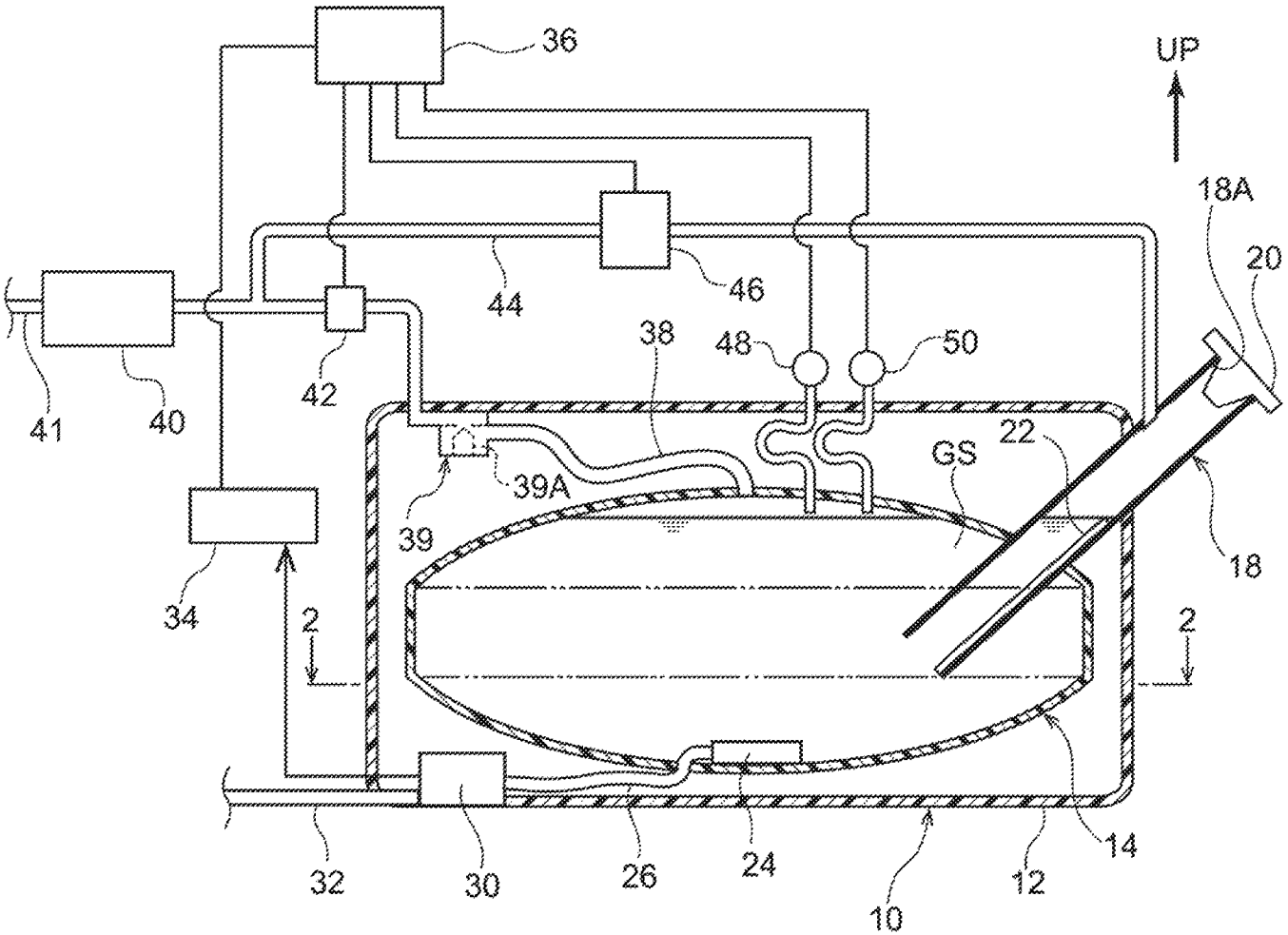
FIG. 1 is a partially broken view that schematically shows a fuel tank structure according to an embodiment, and shows a state in which a holding portion is filled with fuel.

As is shown in FIG. 1, a fuel tank 10 that forms a fuel tank structure according to the present embodiment includes a tank main body portion 12 and a holding portion 14. The tank main body portion 12 is hollow, and makes up an outer shell of the fuel tank 10. A bottom surface of the tank main body portion 12 is supported by a tank band (not shown). The tank main body portion 12 is mounted on a floor panel (not shown) by fixing the tank band to the floor panel with a bracket or the like.

The holding portion 14 is provided inside the tank main body portion 12. The holding portion 14 is formed such that it is able to expand and contract, and is formed in a bag shape that is able to internally hold a fuel liquid (referred to below as 'fuel GS'). Note that the term 'able to expand and contract' used here is not limited to structures in which the actual holding portion 14 itself expands and contracts, but includes bag-shaped components in which the volume of the holding portion 14 is variable and can be shrunk by folding the holding portion 14, and expanded by unfolding the holding portion 14. Furthermore, the holding portion 14 of the present embodiment is not a component that shrinks in parallel with the decrease of the fuel GS but is provided with enough rigidity to maintain its shape until a predetermined pressure (i.e., negative pressure) is applied to it. The shape of the holding portion 14 shown by the solid line in FIG. 1 is what is known as a full tank state when the holding portion 14 is full of the fuel GS, while the shape shown by the double-dot chain line in FIG. 1 is the external shape when the holding portion 14 is in a contracted state.

A substantially cylindrical filler pipe 18 is connected to the holding portion 14. A refueling aperture 18A is formed in a top end portion of the filler pipe 18. Refueling is performed by inserting a nozzle 100A of a fueling gun 100 into the refueling aperture 18A and pouring the fuel GS into the holding portion 14 (see FIG. 6).

The refueling aperture 18A in the top end of the filler pipe 18 is opened and closed by a fuel cap 20. A fuel lid (not shown) that is provided on a side panel or the like of the vehicle body is placed on the outside of the fuel cap 20.

Figure 6:
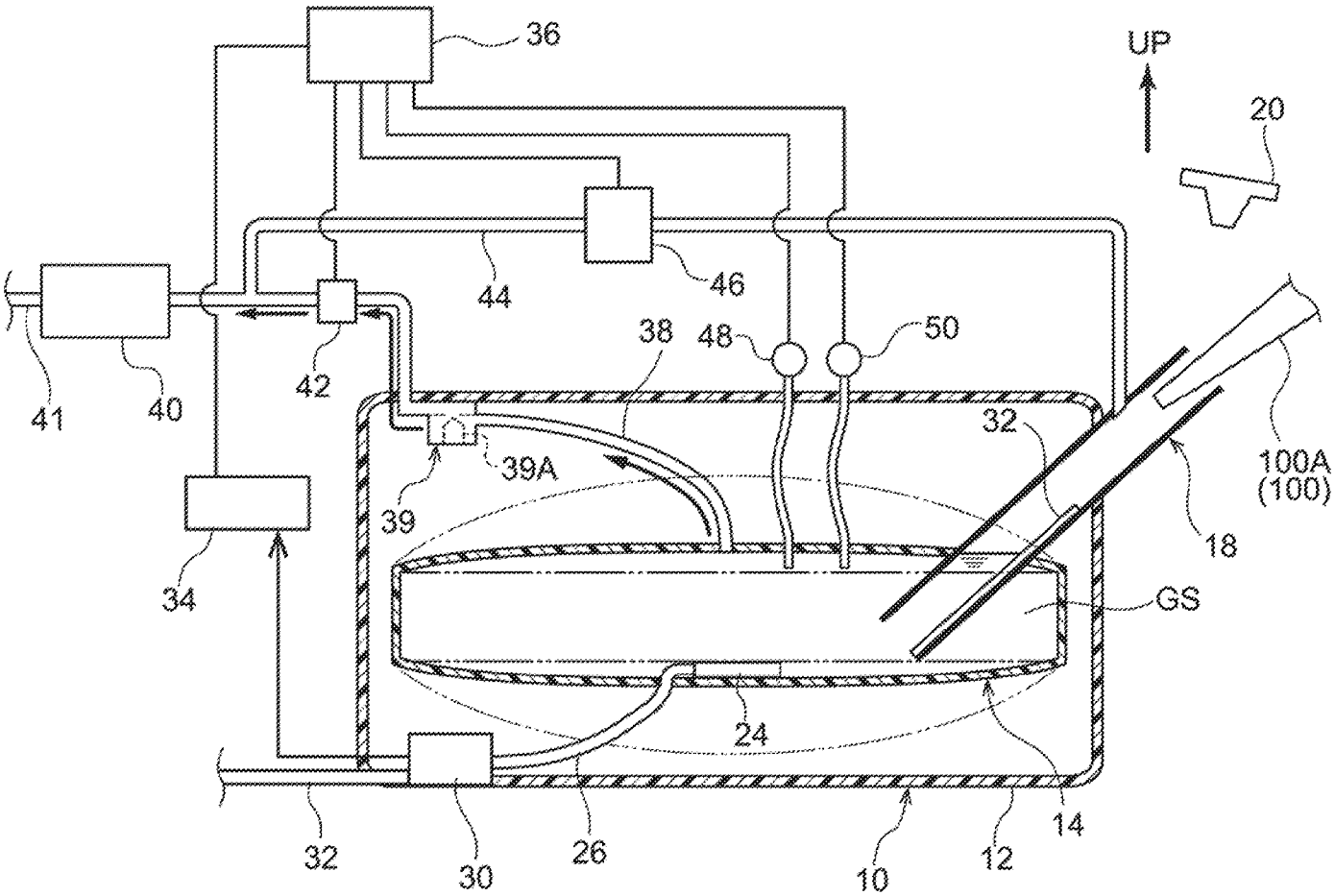
FIG. 6 is a view corresponding to FIG. 1 that shows a state during refueling.

The fuel cap 20 closes the refueling aperture 18A except for during refueling, and restricts access to the filler pipe 18 by the fueling gun 100. In contrast to this, as is shown in FIG. 6, during refueling, the fuel cap 20 is opened up, and the refueling aperture 18A of the filler pipe 18 is opened. As a result, access to the refueling path by the fueling gun 100 is possible.

A liquid level sensor 22 is provided inside the filler pipe 18. The liquid level sensor 22 detects the volume of fuel GS by detecting the level of the fuel GS that is being held inside the holding portion 14. In the present embodiment, the liquid level sensor 22 is formed by an electrostatic capacitance sensor. Note that it is also possible to detect the volume of fuel GS inside the holding portion 14 using another type of sensor. Furthermore, a fuel vapor recovery pipe 44 is also connected to the filler pipe 18 as a second pipe. The fuel vapor recovery pipe 44 is described below in detail.

A filter 24 that is used to capture foreign matter in the fuel GS is provided in a bottom portion of the interior of the holding portion 14. A supply pipe 26 that extends to the outside of the holding portion 14 is connected to the filter 24, and the filter 24 is joined to a fuel pump 30 via the supply pipe 26. The fuel pump 30 feeds the fuel GS to an engine which is an internal combustion engine (not shown). A feeder pipe 32 extends from the fuel pump 30 to the engine. As a consequence, when the fuel pump 30 is operated, the fuel GS inside the holding portion 14 is supplied to the fuel pump 30 through the filter 24, and is then fed to the engine by the fuel pump 30.

Figure 2:
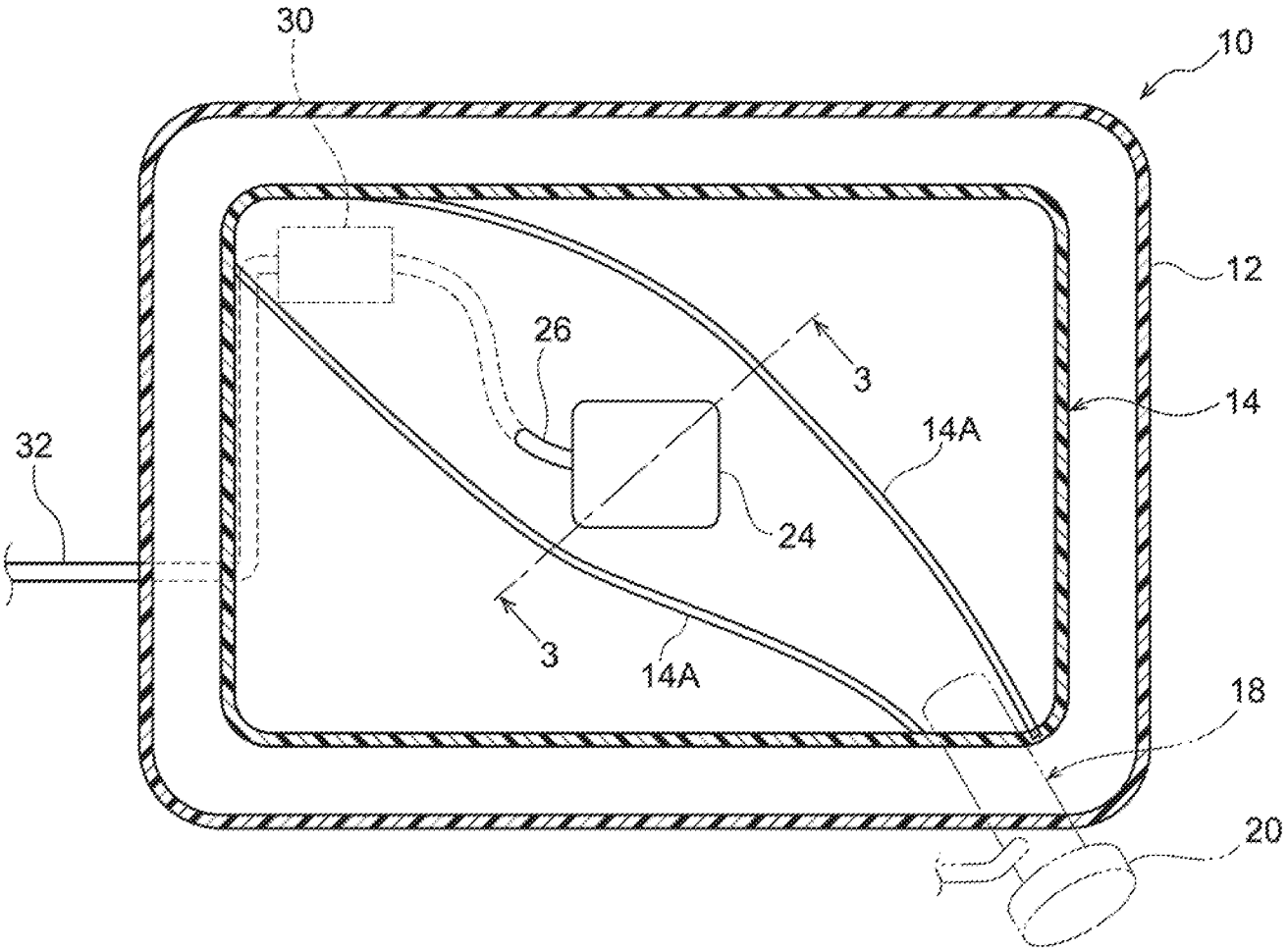
FIG. 2 is a cross-sectional view that shows a state along a cross-section on a line 2-2 shown in FIG. 1.
Figure 3:
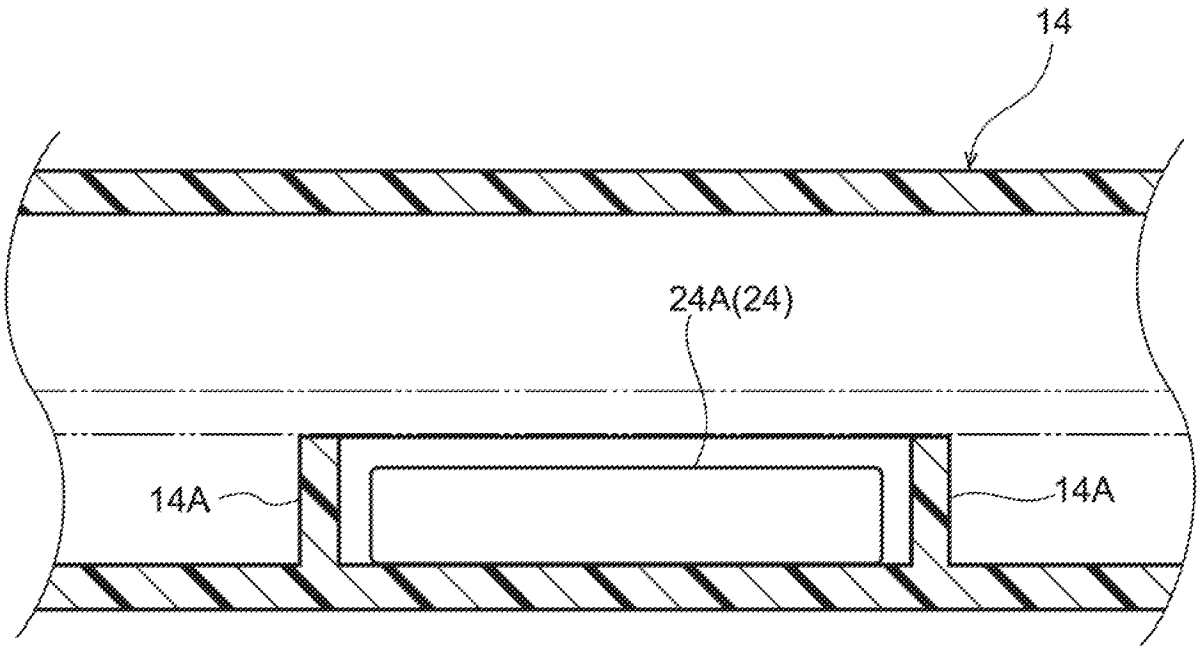
FIG. 3 is an enlarged cross-sectional view that shows an enlargement of a cross-section on a line 3-3 shown in FIG. 2.

Here, as is shown in FIG. 2, a plurality (two in the present embodiment) of ribs 14A are provided standing upright on a bottom portion of the holding portion 14. Each one of the ribs 14A extends in a diagonal direction from a wall surface adjacent to the location where the filler pipe 18 is inserted, and the filter 24 is sandwiched between the ribs 14A when these are seen in plan view. Moreover, as is shown in FIG. 3, the ribs 14A protrude above a top surface 24A of the filter 24. As a result, even when the holding portion 14 has contracted and the top surface side of the holding portion 14 has moved below a position shown by the double-dot chain line in FIG. 3, a flow path of the fuel GS to the outside of the holding portion 14 is prevented by the ribs 14A from becoming constricted. Namely, a structure is employed that makes it possible to secure the flow path of the fuel GS.

Moreover, as is shown in FIG. 1, a fuel pump controller 34 is electrically connected to the fuel pump 30 of the present embodiment. The flow rate of the fuel GS that is fed from the fuel pump 30 to the engine is controlled by the fuel pump controller 34. The fuel pump controller 34 is electrically connected to an ECU (Electronic Control Unit) 36 (described below) which serves as a control unit.

A fuel vapor introduction pipe 38 that serves as a first pipe is connected to a top end portion of the holding portion 14. The fuel vapor introduction pipe 38 joins the holding portion 14 to a canister 40, and is constructed such that evaporative fuel (i.e., fuel vapor) inside the holding portion 14 flows through the fuel vapor introduction pipe 38. The canister 40 communicates with the outside air via an air release pipe 41.

A float valve 39 is provided in the fuel vapor introduction pipe 38. The float valve 39 is provided in a top wall of the tank main body portion 12, and is provided with a float valve body 39A. When the fuel GS reaches the float valve 39, the float valve body 39A floats upwards and blocks off the flow path of the fuel vapor introduction pipe 38. Consequently, the fuel GS is prevented from flowing further towards the canister 40 side from the float valve 39.

Here, a fuel vapor introduction valve 42 is provided as a first shut-off valve at the fuel vapor introduction pipe 38 on the canister 40 side of the float valve 39. When the fuel vapor introduction valve 42 is opened, the fuel vapor introduction pipe 38 is also opened, and movement of the evaporative fuel inside the holding portion 14 to the canister 40 is permitted. On the other hand, when the fuel vapor introduction valve 42 is closed, the fuel vapor introduction pipe 38 is also closed, and movement of the evaporative fuel to the canister 40 is restricted. In the present embodiment, the fuel vapor introduction valve 42 is closed by the ECU 36 after oil is supplied thereto.

Moreover, in the present embodiment, the portion of the fuel vapor introduction pipe 38 that is located on the holding portion 14 side of the float valve 39 is formed by a flexible tube. Because of this, the state of connection between the holding portion 14 and the float valve 39 can be maintained even during the expansion and contraction of the holding portion 14.

The fuel vapor recovery pipe 44 is connected to the fuel vapor introduction pipe 38 adjacently to the canister 40. One end of the fuel vapor recovery pipe 44 is connected to the fuel vapor introduction pipe 38 between the canister 40 and the fuel vapor introduction valve 42. The other end of the fuel vapor recovery pipe 44 is connected to the filler pipe 18. Namely, the filler pipe 18 is joined to the canister 40 by the fuel vapor recovery pipe 44. Moreover, a fuel vapor recovery valve 46 is provided as a second shut-off valve at the fuel vapor recovery pipe 44. When the fuel vapor recovery valve 46 is opened, the fuel vapor recovery pipe 44 is also opened, and movement of the evaporative fuel from the canister 40 to the filler pipe 18 is permitted. On the other hand, when the fuel vapor recovery valve 46 is closed, the fuel vapor recovery pipe 44 is also closed, and movement of the evaporative fuel from the canister 40 to the filler pipe 18 is restricted.

A pressure sensor 48 and a temperature sensor 50 are provided in a top end portion of the holding portion 14. The pressure sensor 48 and the temperature sensor 50 are located adjacent to the connection portion where the fuel vapor introduction pipe 38 is connected to the holding portion 14, and they respectively detect a pressure and a temperature inside the holding portion 14. Here, in the present embodiment, the liquid level of the fuel GS in a full tank state is set such that when the holding portion 14 has been fully filled with the fuel GS, a distal end portion of the pressure sensor 48 and a distal end portion of the temperature sensor 50 are not submerged in the fuel GS. Moreover, the pressure sensor 48 and the temperature sensor 50 are respectively connected to the holding portion 14 by a flexible tube. Because of this, the state of connection between the holding portion 14 and the pressure sensor 48 and temperature sensor 50 can be maintained even during the expansion and contraction of the holding portion 14.

The fuel pump controller 34, the fuel vapor introduction valve 42, the fuel vapor recovery valve 46, the pressure sensor 48, and the temperature sensor 50 are electrically connected to the ECU 36. The adsorption of evaporative fuel in the canister 40 and the recovery of evaporative fuel from the canister 40 are carried out as a result of the fuel vapor introduction valve 42 and the fuel vapor recovery valve 46 being opened and closed based on signals from the ECU 36. Hereinafter, the adsorption of evaporative fuel in the canister 40 during refueling and the recovery of evaporative fuel from the canister 40 will each be described. Note that, in the following description, unless specifically stated otherwise, the fuel vapor introduction valve 42 and the fuel vapor recovery valve 46 are maintained in a closed state.

Firstly, the adsorption of evaporative fuel in the canister 40 during refueling will be described. As is shown in FIG. 6, during refueling, the fuel cap 20 is opened, and the nozzle 100A of the fueling gun 100 is inserted into the refueling aperture 18A. Here, prior to the fuel cap 20 being opened, if a vehicle occupant operates a fuel lid switch (not shown) inside the vehicle compartment, then the fuel lid is opened based on a signal from the ECU 76. In the present embodiment, the fuel vapor introduction valve 42 is opened based on a signal from the ECU 36 at the same timing as the fuel lid is opened. As a consequence of this, a state is created in which the movement of the evaporative fuel inside the holding portion 14 into the canister 40 is permitted. In this state, the fuel GS is injected through the nozzle 100A of the fueling gun 100 into the filler pipe 18, thereby causing the holding portion 14 to expand. In addition, the evaporative fuel inside the holding portion 14 is adsorbed through the fuel vapor introduction pipe 38 in the canister 40, and the remaining gases (i.e., atmospheric constituents) are discharged into the atmosphere. Note that when the fuel GS reaches the liquid level of a full tank, the auto-stop function of the fueling gun 100 comes into operation and the refueling is stopped. Thereafter, at the same timing as the fuel lid is closed, the fuel vapor introduction valve 42 is also closed based on a signal from the ECU 36.

Figure 4:
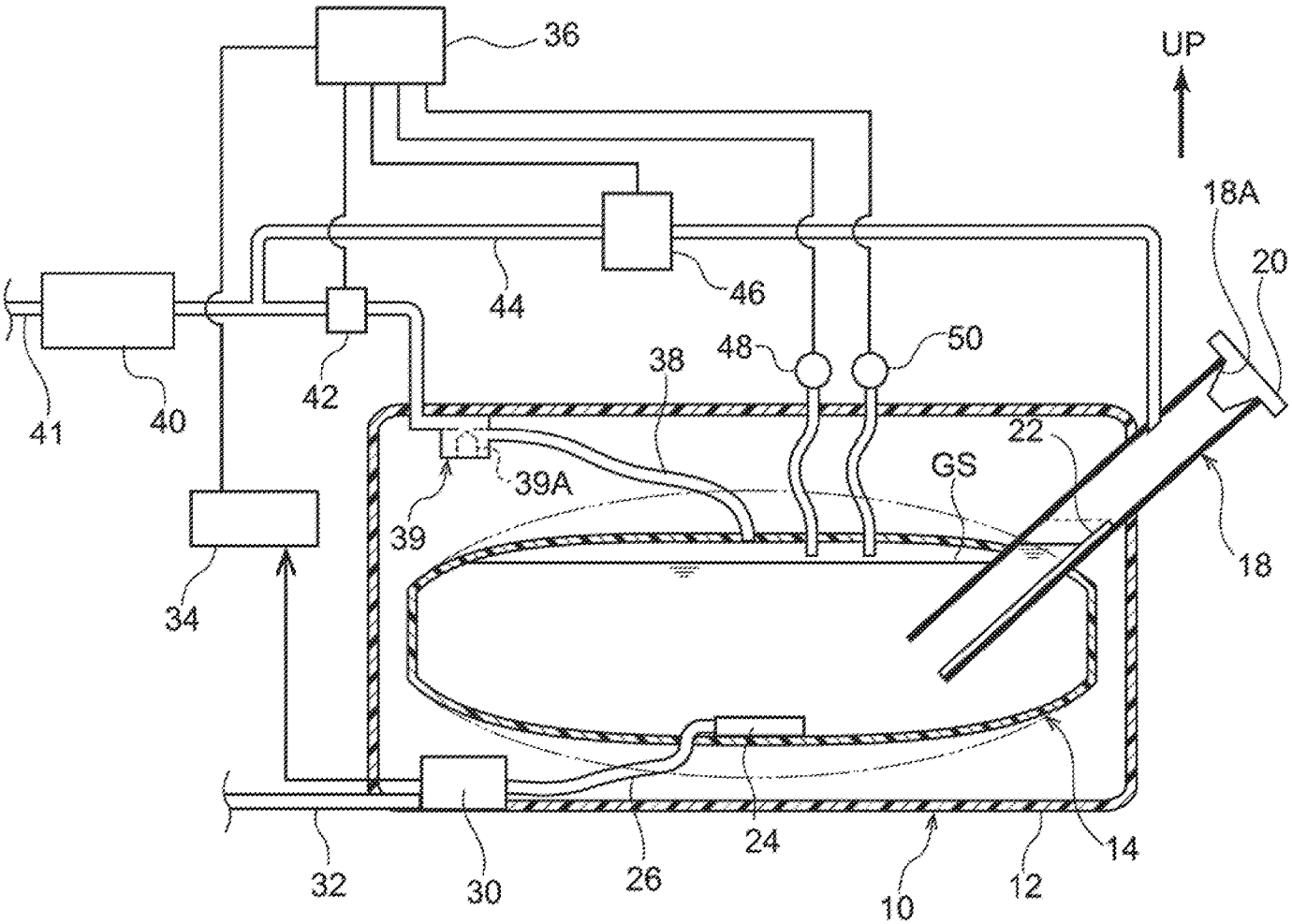
FIG. 4 is a view corresponding to FIG. 1 that shows a state in which the fuel inside the holding portion has decreased.

Next, the recovery of evaporative fuel from the canister 40 will be described. As is shown in FIG. 4, when the fuel GS inside the holding portion 14 is fed by the fuel pump 30 to the engine, the fuel GS inside the holding portion 14 decreases so that the liquid level of the fuel GS inside the holding portion 14 and the filler pipe 18 is lowered. Here, because the fuel vapor introduction valve 42 and the fuel vapor recovery valve 46 are closed, the space inside the holding portion 14 and the filler pipe 18 is tightly sealed. Because of this, the pressure inside the holding portion 14 and the filler pipe 18 is lowered by the decrease in the fuel GS inside the holding portion 14, so that negative pressure comes into operation. The holding portion 14 is then contracted by this negative pressure. Note that the double-dot chain line in FIG. 4 shows the external shape of the holding portion 14 when it is full, and also shows the liquid level of the fuel GS inside the filler pipe 18 when the holding portion 14 is full.

Figure 5:
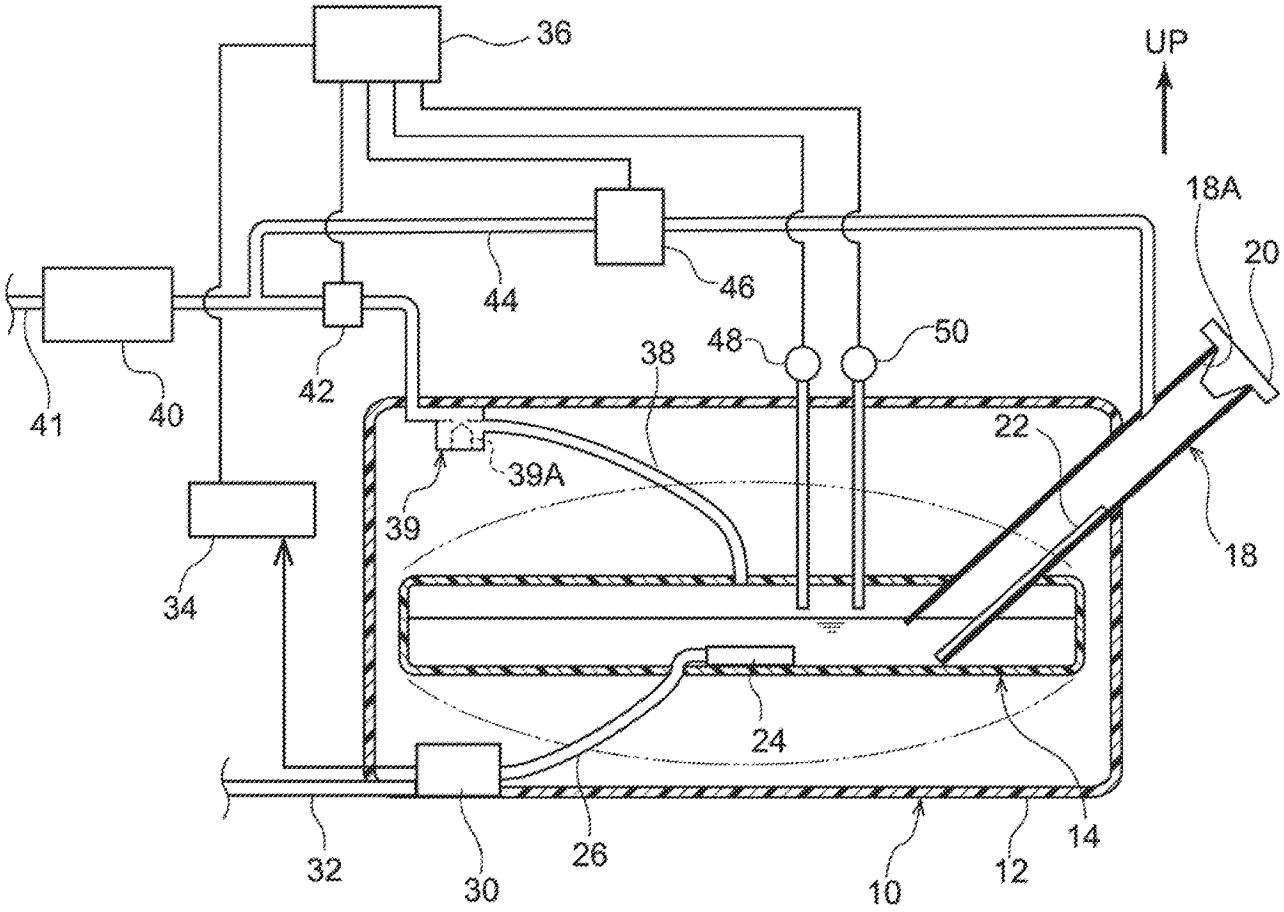
FIG. 5 is a view corresponding to FIG. 1 that shows a state in which fuel that has been adsorbed into the canister is recovered.

If the fuel GS inside the holding portion 14 further decreases from the state shown in FIG. 4, then as is shown in FIG. 5, the liquid level of the fuel GS is further lowered, and the pressure inside the holding portion 14 and the filler pipe 18 is further reduced. When the pressure inside the holding portion 14 which is detected by the pressure sensor 48 drops below a predetermined, pressure which is lower than the atmospheric pressure, the fuel vapor recovery valve 46 is opened based on a signal from the ECU 36.

When the fuel vapor recovery valve 46 is opened, negative pressure is applied to the canister 40 and atmospheric air is introduced through the canister 40 into the fuel vapor recovery pipe 44. In addition, the evaporative fuel that has been adsorbed in the canister 40 is purged. The purged evaporative fuel flows into the holding portion 14 through the fuel vapor recovery pipe 44 and the filler pipe 18. In this way, the evaporative fuel adsorbed by the canister 40 is recovered.

Here, the fuel vapor recovery valve 46 of the present embodiment is constructed such that it is possible to adjust the flow rate of the evaporative fuel flowing through the fuel vapor recovery pipe 44. Namely, by altering the opening angle of the fuel vapor recovery valve 46, it is possible to adjust the flow rate of the evaporative fuel flowing through the fuel recovery pipe 44.

Moreover, the fuel vapor recovery valve 46 is controlled by the ECU 36 such that the flow rate of the evaporative fuel flowing through the fuel vapor recovery pipe 44 (hereinafter, referred to as a 'flow rate q') is less than the flow rate of the fuel that is fed to the engine from the fuel pump 30 (referred to below as a 'flow rate Q'). Specifically, the ECU 36 uses information that is received from the fuel pump controller 34 to acquire the flow rate Q of the fuel GS that is fed to the engine. The ECU 36 then adjusts the opening angle of the fuel vapor recovery valve 46 such that the flow rate q of the evaporative fuel flowing through the fuel vapor recovery tube 44 is less than the flow rate Q.

At this time, if the flow velocity of the evaporative fuel flowing through the fuel vapor recovery pipe 44 is taken as U, and the flow path area of the fuel vapor recovery pipe 44 is taken as A, then the flow rate q can be expressed using the following Formula (1):

[Formula 1]

$$q = U \times A \tag{1}$$

On the other hand, if the pressure shown by the pressure sensor 48 is taken as $P_1$, and the atmospheric pressure is taken as $P_0$, then $P_1 - P_0$ can be expressed by the relational equation in the following Formula (2) using a pressure loss calculation formula (Fanning's equation). Note that in Formula (2), λ is the coefficient of pipe friction of the fuel vapor recovery pipe 44, l is the pipe length, d is the pipe diameter, and ρ is the density of the evaporative fuel.

[Formula 2]

$$P_1 - P_0 = \lambda \times \frac{l}{d} \times \frac{1}{2} \times \rho \times U^2 \tag{2}$$

By calculating U from Formula (2), and assigning it as the U in Formula (1), the flow rate q can be determined. Note that this calculation is performed by the ECU 36. The pipe diameter d is then adjusted by controlling the fuel vapor recovery valve 46 such that a determined flow rate q is less than the flow rate Q.

If the fuel GS inside the holding portion 14 decreases further from the state shown in FIG. 5 so that the liquid level of the fuel GS detected by the liquid level sensor 22 drops below a predetermined level, the fuel vapor recovery valve 46 is closed based on a signal from the ECU 36, and the evaporative fuel recovery is halted.

(Operations and Effects)

Next, the operations and effects of the fuel tank structure according, to the present embodiment will be described.

In the present embodiment, because the fuel vapor introduction valve 42 is opened based on a signal from the ECU during refueling, evaporative fuel moves from the holding portion 14 to the canister 40, and the evaporative fuel can be adsorbed in the canister 40. Moreover, gaseous components apart from the evaporative fuel are discharged into the atmosphere. As a result, it is possible to prevent evaporative fuel from being discharged into the atmosphere.

In the event that, as a result of the fuel GS inside the holding portion 14 being fed to the engine by the fuel pump 30, the pressure inside the holding portion 14 drops below a predetermined pressure that is lower than the atmospheric pressure, the fuel vapor recovery valve 46 is opened based on a signal from the ECU 36. As a result, the evaporative fuel adsorbed in the canister 40 is purged from the canister, and flows into the holding portion 14. In this manner, it is possible to recover the evaporative fuel adsorbed in the canister 40 by a simple structure without using an apparatus such as a gas separator. Moreover, because negative pressure from the intake manifold is not utilized, pumping loss is suppressed, and fuel consumption can be improved.

Furthermore, because evaporative fuel can be recovered to the holding portion 14 of the fuel tank 10 from the canister 40 even when the engine is in a stopped state, the present invention can also be applied to vehicles such as hybrid vehicles that travel using driving power from a motor when the engine is stopped.

Moreover, in the present embodiment, the fuel vapor recovery valve 46 is controlled such that the flow rate of the evaporative fuel flowing through the fuel vapor recovery pipe 44 is less than the flow rate Q of the fuel being fed to the engine from the fuel pump 30. For this reason, the negative pressure inside the holding portion 14 can be maintained when the evaporative fuel recovery is performed, and it is possible to stably recover evaporative fuel from the canister 40. Namely, the evaporative fuel recovery performance can be improved.

Furthermore, as is shown in FIG. 3, in the present embodiment, constriction of the now path of the fuel GS when the holding portion 14 is contracted is prevented by the ribs 14A. As a result, the fuel GS can flow stably to the fuel pump 30 even when there is only a small quantity of the fuel GS inside the holding portion 14.

Embodiments of the present invention have been described above, however, it should be understood that the present invention is not limited to the above-described structure. Various modifications and the like may be made to the above-described structure insofar as they do not depart from the scope of the present invention. For example, in the present embodiment, the holding portion 14 has an expandable/contractible structure, however, the present invention is not limited to this and it is also possible to form the holding portion from a component that does not expand or contract.

Moreover, in the present embodiment, a structure is employed in which the fuel vapor introduction valve 42 is opened based on a signal from the ECU 36 at the same timing as the fuel lid is opened, however, the present invention is not limited to this. For example, it is also possible to provide a sensor that detects the open or closed state of the fuel cap 20, and to open the fuel vapor introduction valve 42 at the same timing as the fuel cap 20 is opened.

Furthermore, in the present embodiment, the fuel vapor recovery valve 46 is opened based on the pressure inside the holding portion 14 that is detected by the pressure sensor 48, however, the present invention is not limited to this. It is also possible to employ a structure in which the fuel vapor recovery valve 46 is opened based on information from both the pressure sensor 48 and the temperature sensor 50. Because the pressure inside the holding portion 14 decreases if the temperature inside the holding portion 14 falls, by detecting the pressure and temperature inside the holding portion 14 using the pressure sensor 48 and the temperature sensor 50, and controlling the fuel vapor recovery valve 46 based on information from these two sensors, the fuel vapor recovery valve 46 can be controlled even more accurately.

What is claimed is:

1. A fuel tank structure comprising:

a fuel tank that is mounted in a vehicle and that is provided with a holding portion that holds fuel;

a canister that communicates with the outside atmosphere;

a first pipe that directly joins together the holding portion and the canister;

a first shut-off valve that opens and closes the first pipe;

a filler pipe that is connected to the holding portion, and that is provided with a refueling aperture into which a nozzle of a fueling gun is inserted and that remains closed other than during refueling;

a second pipe that joins together the filler pipe and the canister;

a second shut-off valve that opens and closes the second pipe;

a pressure sensor that detects the pressure inside the holding portion;

a fuel pump that feeds the fuel inside the holding portion to an engine; and a control unit that:

opens the first shut-off valve during refueling so that evaporative fuel moves from the holding portion of the fuel tank to the canister, closes the first shut-off valve after refueling, and opens the second shut-off valve to purge the evaporative fuel absorbed at the canister towards the fuel tank through the second pipe and the filler pipe (1) when the first shut-off valve is closed, and (2) when the pressure inside the holding portion drops below a predetermined pressure that is lower than the atmospheric pressure.

2. The fuel tank structure according to claim 1, wherein the second shut-off valve is formed so as to be able to adjust a flow rate of the evaporative fuel flowing through the second pipe, and the control unit controls the second shut-off valve such that the flow rate of the evaporative fuel flowing through the second pipe is less than a flow rate of the fuel being fed to the engine by the fuel pump.

3. The fuel tank structure according to claim 1, wherein the holding portion is formed so as to be able to expand and contract, and a plurality of ribs are provided standing upright on a bottom portion of the holding portion.

4. The fuel tank structure according to claim 3, further comprising a filter at the bottom of the holding portion, the filter is sandwiched between the plurality of ribs in plan view.

5. A fuel tank structure comprising:

a fuel tank that is mounted in a vehicle and that is provided with a holding portion that holds fuel;

a canister that communicates with the outside atmosphere;

a first pipe that directly joins together the holding portion and the canister;

a first shut-off valve that opens and closes the first pipe;

a filler pipe that is connected to the holding portion, and that is provided with a refueling aperture into which a nozzle of a fueling gun is inserted and that remains closed other than during refueling;

a second pipe that joins together the filler pipe and the canister;

a second shut-off valve that opens and closes the second pipe;

a pressure sensor that detects the pressure inside the holding portion;

a fuel pump that feeds the fuel inside the holding portion to an engine; and a control unit that:

opens the first shut-off valve during refueling so that evaporative fuel moves from the holding portion of the fuel tank to the canister, closes the first shut-off valve after refueling, and opens the second shut-off valve to purge the evaporative fuel towards the fuel tank (1) when the first shut-off valve is closed, and (2) when the pressure inside the holding portion drops below a predetermined pressure that is lower than the atmospheric pressure, wherein, a fuel is injected into the filler pipe whereby the holding portion is expanded, and in a case in which a pressure inside the holding portion and the filler pipe is lowered by the decrease of the fuel inside the holding portion, negative pressure comes into operation and the holding portion is contracted by the negative pressure.

6. The fuel tank structure according to claim 5, wherein the control unit opens the second shut-off valve to purge the evaporative fuel absorbed at the canister towards the fuel tank through the second pipe and the filler pipe (1) when the first shut-off valve is closed, and (2) when the pressure inside the holding portion drops below a predetermined pressure that is lower than the atmospheric pressure.

7. The fuel tank structure according to claim 5, wherein the holding portion is formed in a bag shape.

* * * * *